US007669693B2

(12) United States Patent
Yamaguchi et al.

(10) Patent No.: US 7,669,693 B2
(45) Date of Patent: Mar. 2, 2010

(54) EXHAUST MUFFLING DEVICE

(75) Inventors: Junichi Yamaguchi, Kasugai (JP); Tadashi Kondo, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 137 days.

(21) Appl. No.: 10/981,514

(22) Filed: Nov. 5, 2004

(65) Prior Publication Data

US 2005/0126850 A1 Jun. 16, 2005

(30) Foreign Application Priority Data

Dec. 12, 2003 (JP) ..... 2003-415415

(51) Int. Cl.
*F01N 1/02* (2006.01)

(52) U.S. Cl. ..... 181/255; 181/249; 181/269

(58) Field of Classification Search ..... 181/249, 181/251, 255, 268, 269, 272, 275, 257
See application file for complete search history.

(56) References Cited

U.S. PATENT DOCUMENTS 2,928,492 A * 3/1960 Nelson ..... 181/275
2,958,389 A * 11/1960 Deremer ..... 181/266
2,958,398 A * 11/1960 Newell ..... 188/52
3,220,507 A * 11/1965 Jettinghoff ..... 181/265
3,441,105 A * 4/1969 Hubbell ..... 181/282
4,102,430 A * 7/1978 Wilson ..... 181/265
4,122,914 A * 10/1978 Suyama ..... 181/258
4,124,092 A * 11/1978 Kajiya et al. ..... 181/265
4,192,401 A * 3/1980 Deaver et al. ..... 181/266
4,192,403 A * 3/1980 Nakagawa et al. ..... 181/268
4,360,076 A * 11/1982 Suyama ..... 181/265
4,589,517 A * 5/1986 Fukuda ..... 181/265
4,905,791 A * 3/1990 Garey ..... 181/282
4,971,166 A * 11/1990 Hase ..... 181/254
5,052,513 A * 10/1991 Yoshikawa et al. ..... 181/246
5,107,953 A * 4/1992 Shimizu et al. ..... 181/282
5,677,518 A * 10/1997 Fischer et al. ..... 181/269
5,717,173 A * 2/1998 Gerber et al. ..... 181/243
5,739,483 A * 4/1998 Yashiro et al. ..... 181/254
5,929,398 A * 7/1999 Amino et al. ..... 181/272
6,173,808 B1 * 1/2001 Maeda et al. ..... 181/254
6,260,659 B1 * 7/2001 Takahashi et al. ..... 181/255
6,427,802 B1 * 8/2002 Yokoi et al. ..... 181/282
2002/0148679 A1 * 10/2002 Grandmougin et al. ..... 181/272
2003/0155175 A1 * 8/2003 Kaku et al. ..... 181/227

(Continued)

FOREIGN PATENT DOCUMENTS

DE 685768 C 12/1939

(Continued)

*Primary Examiner*—Jeffrey Donels
*Assistant Examiner*—Jeremy Luks
(74) *Attorney, Agent, or Firm*—Oliff & Berridge, PLC

(57) ABSTRACT

An object of the present invention is to provide an exhaust muffling device having a simple structure, which is capable of suppressing air column resonance favorably, irrespective of a length of an outlet pipe of an exhaust pipe which communicates with a muffler, and with which it is possible to achieve appropriate reductions in weight and cost. The exhaust muffling device of the present invention comprises a muffler having an expansion chamber whose length is L in an exhaust direction, and an outlet pipe being in communication with the expansion chamber and whose pipe length is approximately 2nL in which n is a natural number.

7 Claims, 5 Drawing Sheets

U.S. PATENT DOCUMENTS

2004/0069562 A1 4/2004 Kondo et al.

FOREIGN PATENT DOCUMENTS

DE 753765 C 7/1951
DE 2738601 A1 7/1978
DE 3711029 A1 10/1987
JP A 59-226222 12/1984
JP A 61-138813 6/1986

* cited by examiner $L_2 \fallingdotseq 2nL_1$ (WHERE n IS A NATURAL NUMBER)

FIRST ACOUSTIC MODE $\lambda_1 \fallingdotseq 2L_2$

SECOND HARMONIC $\lambda_2 \fallingdotseq L_2$

THIRD HARMONIC $\lambda_3 \fallingdotseq \frac{2}{3}L_2$

FOURTH HARMONIC $\lambda_4 \fallingdotseq \frac{1}{2}L_2$

EXHAUST MUFFLING DEVICE

BACKGROUND

The present invention relates to an exhaust muffling device for reducing exhaust noise by suppressing air column resonance.

Conventionally, in this type of exhaust muffling device installed in an internal combustion engine, a plurality of mufflers are arranged-over an exhaust pipe which communicates with an exhaust manifold in order to suppress air column resonance generated in the exhaust pipe. For example, a constitution is known whereby a length from a convergence point of an exhaust manifold to a terminal outlet of an exhaust pipe is set as a reference length (X), a first muffler is provided in a position of 3X/5 from the terminal outlet, and a second muffler is provided in a position of 2X/5 from the terminal outlet. This type of exhaust muffling device is disclosed in Japanese Laid-Open Patent Publication No. S59-226222.

By providing a plurality of mufflers in appropriate locations, this type of conventional exhaust muffling device is capable of muffling exhaust noise favorably. However, the overall weight is increased by the provision of the plurality of mufflers, which is likely to lead to an increase in cost. To consider this problem simply, if the second muffler of the exhaust muffling device described in Japanese Laid-Open Patent Publication No. S59-226222 were omitted, for example, then a pipe length from the first muffler to the terminal outlet would increase, and especially if this length were to reach or exceed 1.5 m, for example, air column resonance would occur in the normal rotation region of the internal combustion engine, causing the sound pressure level of the exhaust gas to increase.

SUMMARY

An object of the present invention is to provide an exhaust muffling device having a simple structure, which is capable of suppressing air column resonance favorably, irrespective of the length of an outlet pipe of an exhaust pipe connected to a muffler, and with which it is possible to achieve appropriate reductions in weight and cost.

To attain the above object, an exhaust muffling device according to the present invention comprises a muffler having an expansion chamber whose length is L in an exhaust direction, and an outlet pipe which is communication with the expansion chamber and whose pipe length is approximately 2nL in which n is a natural number.

According to this constitution, when air column resonance is generated inside the outlet pipe at a specific frequency corresponding to the pipe length of the outlet pipe, the length ratio is set as described above, and hence the air column resonance is suppressed effectively by means of an interference effect inside the expansion chamber.

More specifically, a fundamental wavelength $\lambda_1$ of the air column resonance generated inside the outlet pipe is approximately double the pipe length of the outlet pipe, and hence to effectively suppress this air column resonance by means of an interference effect between the incident waves and reflected waves inside the expansion chamber, the length L of the expansion chamber should be set to ¼ of the fundamental wavelength $\lambda_1$. In other words, a relationship of expansion chamber length:pipe length of outlet pipe being approximately 1:2 should be established. Similarly, a wavelength $\lambda_2$ of air column resonance at a second harmonic is approximately equal to the pipe length, and hence by setting the length L of the expansion chamber to ¼ of $\lambda_2$ in order to obtain an interference effect, a relationship of expansion chamber length: pipe length of outlet pipe being approximately 1:4 is established. Similarly with a third harmonic and fourth harmonic, relationships of 1:6 and 1:8 are established respectively.

Thus in the present invention, the relationship of expansion chamber length:pipe length of outlet pipe being approximately 1:2n is established, and hence even when the pipe length of the outlet pipe is great, air column resonance of the $n^{th}$ harmonic can be suppressed favorably. Note that the "approximately" of "approximately 2nL" is a concept incorporating open end correction. Namely, the pipe length of the outlet pipe defines 2nL plus δL in which δL is the open end correction (compensation).

Preferably, the muffler further comprises a resonance chamber adjacent to the expansion chamber. More preferably the exhaust muffling device further comprises an inlet pipe which communicates with the resonance chamber and expansion chamber.

Another exhaust muffling device according to the present invention comprises a muffler having an expansion chamber whose length is L in an exhaust direction, and an outlet pipe having a first open end face, a second open end face and a through hole formed in a peripheral wall of the outlet pipe near the first open end face. The first open end face is in communication with the expansion chamber, the through hole is in communication with an inside of the muffler, and a length of the outlet pipe from the through hole to the second open end face is approximately 2nL in which n is a natural number.

According to this constitution, when air column resonance is generated inside the outlet pipe in accordance with a partial length (to be referred to hereinafter as the "substantial air column length") of the outlet pipe from the through hole formed in the peripheral wall thereof to the second open end face, a relationship of expansion chamber length:substantial air column length being approximately 1:2n is established, and hence air column resonance of the $n^{th}$ harmonic can be suppressed effectively by means of an interference effect inside the expansion chamber in a similar manner to that described above.

Note that the through hole formed in the peripheral wall may communicate with the expansion chamber inside the muffler in order to function as a so-called bypass hole. Alternatively, the through hole may communicate with a resonance chamber provided separately inside the muffler in order to reduce exhaust noise of a different frequency to the frequency of the air column resonance to be suppressed. When a plurality of the through holes are formed in a longitudinal direction of the outlet pipe, the through hole which is closest to the second open end face serves as a reference for the substantial air column length.

In these cases, the natural number n is preferably 1 or 2.

According to this constitution, air column resonance having a long wavelength, which is typically difficult to muffle, can be suppressed appropriately.

According to the exhaust muffling device of the present invention, air column resonance can be suppressed favorably using a simple structure, irrespective of the length of the outlet pipe, thereby enabling an improvement in the muffling performance. As a result, a separate sub-muffler does not have to be provided in the outlet pipe, enabling appropriate reductions in weight and cost.

DETAILED DESCRIPTION

Figures 1A, 1B:
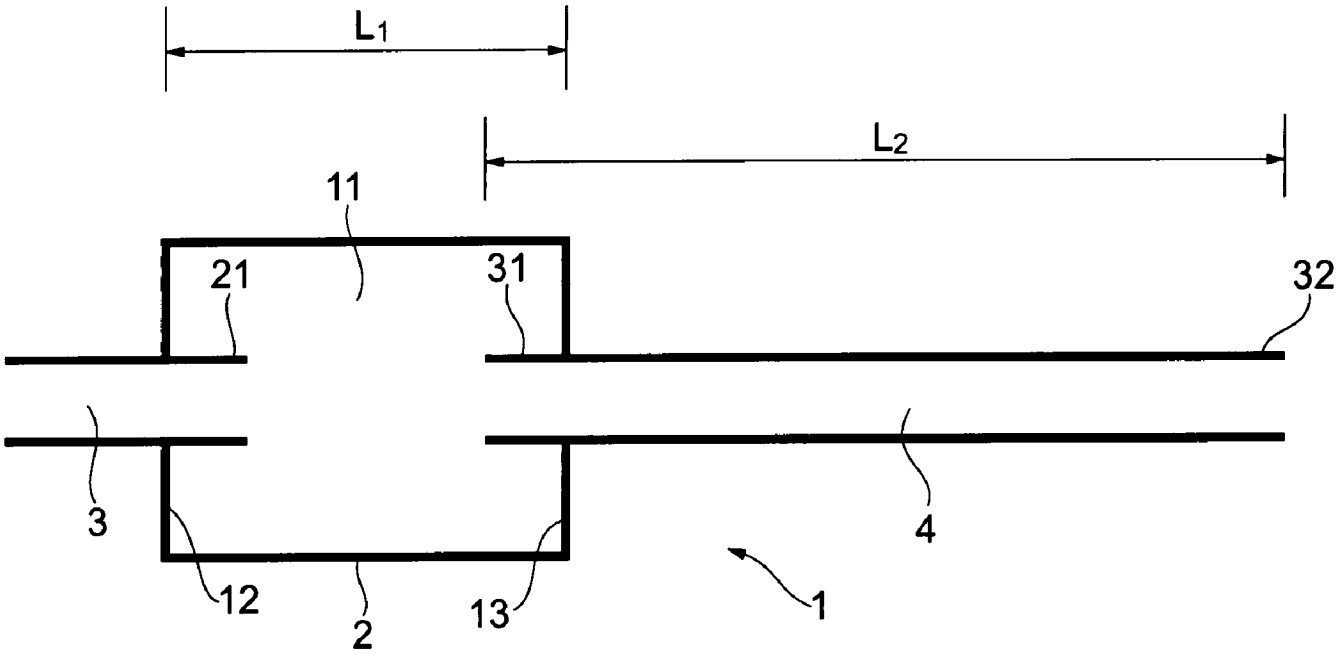
FIG. 1A is a schematic diagram showing an outline of an exhaust muffling device according to a first embodiment of the present invention.
FIG. 1B is a view showing a relational expression between an expansion chamber and an outlet pipe in FIG. 1A.

An exhaust muffling device according to preferred embodiments of the present invention will be described below with reference to attached drawings. The exhaust muffling device is used to reduce exhaust noise by setting the length of an expansion chamber in a muffler and a pipe length of an outlet pipe to a predetermined ratio such that air column resonance is suppressed effectively. In the following description, an example is provided in which the exhaust muffling device is applied to an exhaust system of an internal combustion engine in an automobile.

First Embodiment

As shown in FIG. 1, an exhaust muffling device 1 comprises a muffler 2 for muffling the exhaust noise of exhaust gas discharged from an internal combustion engine, an inlet pipe 3 of an exhaust pipe for introducing the exhaust gas into the muffler 2 from the internal combustion engine, and an outlet pipe 4 of the exhaust pipe for discharging the exhaust gas outside from the muffler 2.

A single expansion chamber 11 having a length of $L_1$ in an exhaust direction is disposed in an interior of the muffler 2. The expansion chamber 11 is formed with a larger exhaust gas passage sectional area than the inlet pipe 3, and hence the pressure of the exhaust gas that flows into the expansion chamber 11 from the inlet pipe 3 decreases. The length $L_1$ of the expansion chamber 11 in this case corresponds to a distance between inner walls 12, 13 facing each other in the exhaust direction of the muffler 2.

One open end portion of the inlet pipe 3 communicates with an exhaust manifold, not shown in the drawing, in the internal combustion engine, and the other open end portion 21 communicates with the expansion chamber 11 via the inner wall 12 of the muffler 2. A pipe length of the outlet pipe 4 is set to $L_2$. One open end portion 31 of the outlet pipe 4 communicates with the expansion chamber 11 via the inner wall 13 of the muffler 2, and the other open end portion 32 communicates with the outside, and is therefore open to the atmosphere.

When the internal combustion engine is operative, an exhaust pulse generates air column resonance in the outlet pipe 4 in accordance with the pipe length $L_2$ of the outlet pipe 4. In other words, as shown in FIG. 2, the first acoustic mode of the air column resonance is set with the pipe length $L_2$ as a half wavelength, and air column resonance is generated in wavelengths of natural number multiples of this half wavelength.

Figure 2A:
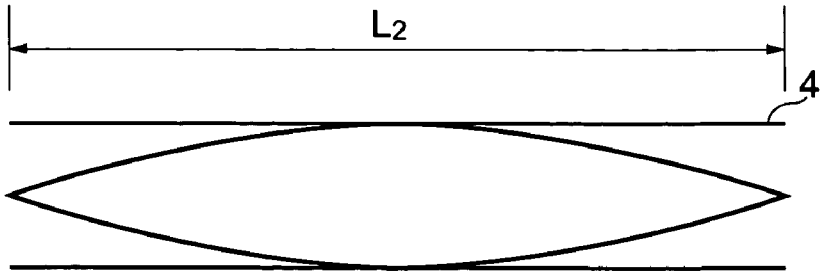
FIG. 2A is a view illustrating a first acoustic mode of air column resonance generated inside the outlet pipe.

More specifically, a wavelength $\lambda_1$ of air column resonance at the first acoustic mode (first harmonic) is approximately double the pipe length $L_2$, taking into account open end correction of the outlet pipe 4 (see FIG. 2A). To suppress this air column resonance effectively by means of an interference effect between the incident waves and reflected waves inside the expansion chamber 11, the length $L_1$ of the expansion chamber 11 should be set to ¼ of the wavelength $\lambda_1$. In other words, by establishing a relationship of $L_1$:$L_2$ being approximately 1:2, exhaust noise generated by air column resonance at the first acoustic mode is reduced.

Figure 2B:
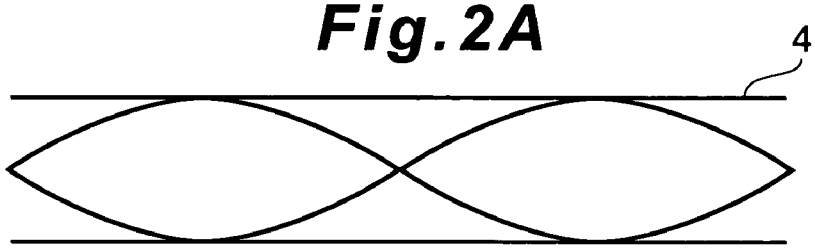
FIG. 2B is a view illustrating a second harmonic of the air column resonance generated within the outlet pipe.
Figure 2C:
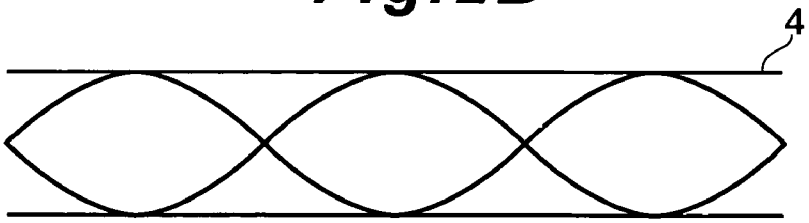
FIG. 2C is a view illustrating a third harmonic of the air column resonance generated within the outlet pipe.
Figure 2D:
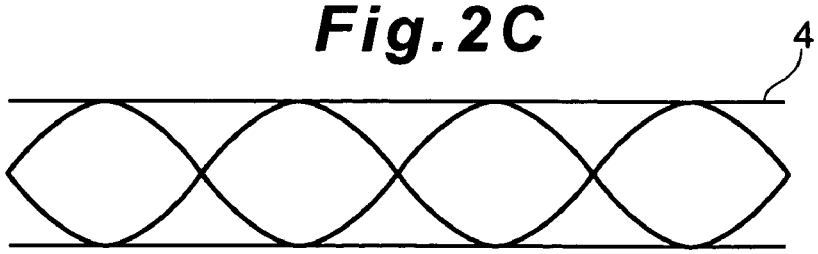
FIG. 2D is a view illustrating a fourth harmonic of the air column resonance generated within the outlet pipe.

As shown in FIG. 2B, a wavelength $\lambda_2$ of second harmonic air column resonance is approximately equal to the pipe length $L_2$, and hence to obtain a similar interference effect, the length $L_1$ of the expansion chamber 11 should be set to ¼ of $\lambda_2$. In other words, by establishing a relationship of $L_1$:$L_2$ being approximately 1:4, exhaust noise generated by second harmonic air column resonance is reduced. Likewise, as shown in FIGS. 2C and 2D, at the third harmonic, $L_1$ should be set to ¼ of $\lambda_3$, and at the fourth harmonic, $L_1$ should be set to ¼ of $\lambda_4$. Hence, by establishing relationships of $L_1$:$L_2$ being approximately 1:6 and $L_1$:$L_2$ being approximately 1:8 respectively, exhaust noise generated by air column resonance corresponding to the third and fourth harmonic is reduced.

Accordingly, in this embodiment a relationship of $L_2$ being approximately $2nL_1$ (where n is a natural number) is established, as shown in FIG. 1B. Thus air column resonance of the $n^{th}$ harmonic can be suppressed favorably, enabling exhaust noise to be muffled in totality. A particularly useful muffling effect is obtained when the natural number "n" is set to 1 or 2, which corresponds to air column resonance having a long wavelength (low frequency) that is usually difficult to muffle. More specifically, when the pipe length $L_2$ of the outlet pipe 4 is great, for example 1.5 m or more, low frequency air column resonance can be generated in a normal rotation region of the internal combustion engine, but this air column resonance can be suppressed effectively.

According to the exhaust muffling device 1 of this embodiment, the effective length of the expansion chamber 11 is set in relation to the outlet pipe 4, and hence the muffling performance can be increased sufficiently without providing a separate muffler (sub-muffler) in the outlet pipe 4. As a result, sub-mufflers can be omitted from the constitution of the exhaust muffling device 1, enabling reductions in weight and cost. From the point of view of an automobile, these effects enable a reduction in the space occupied by the exhaust muffling device 1, and hence on the automobile side, convenience is enhanced.

Note that in the embodiment described above, a single expansion chamber 11 is provided in the muffler 2, but a plurality of expansion chambers may be provided in the exhaust direction by dividing the interior of the muffler 2 using partition walls to form a so-called multistage expansion constitution. In this case, two adjacent expansion chambers may be considered as a single expansion chamber by providing an opening with a large opening ratio in the partition wall, thereby enabling communication between the adjacent expansion chambers on either side of the opening. By setting the pipe length $L_2$ of the outlet pipe 4 at a approximately even-numbered multiples of the total length $L_2$ of the plurality of expansion chambers in the exhaust direction ($L_2$ being approximately $2nL_1$), identical effects to those described above can be obtained.

Next, other embodiments of the exhaust muffling device 1 according to the present invention will be described. Note that the descriptions of each of the following embodiments focus on differences with the first embodiment, and hence identical members and target lengths have been allocated identical reference symbols.

Second Embodiment

Figure 3:
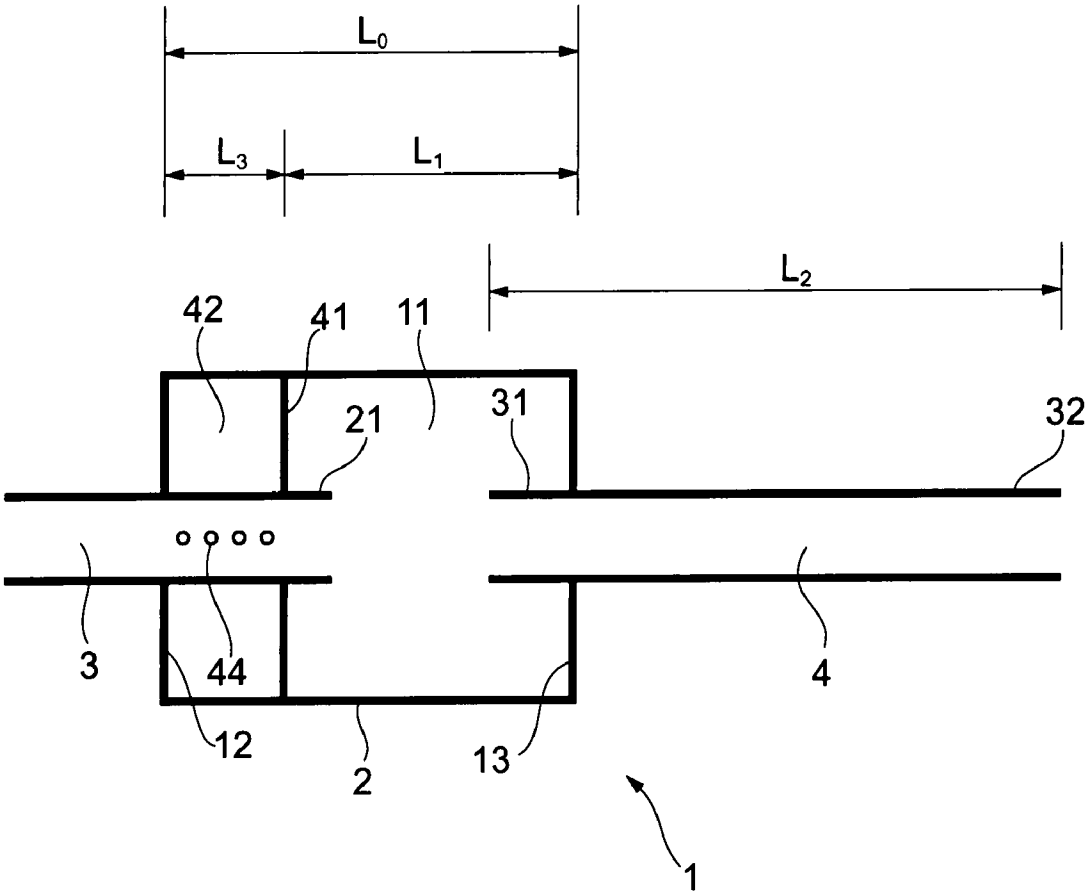
FIG. 3 is a schematic diagram showing an outline of an exhaust muffling device according to a second embodiment of the present invention.

As shown in FIG. 3, the interior of the muffler 2 in the exhaust muffling device 1 according to a second embodiment is separated into a resonance chamber 42 disposed on the inlet pipe 3 side, and the expansion chamber 11 disposed on the outlet pipe 4 side, using a separator 41. The length $L_1$ of the expansion chamber 11 in the exhaust direction corresponds to a distance from the separator 41 to the inner wall 13 of the muffler 2 near the outlet pipe 4. The resonance chamber 42 serves to resonate with oscillation of a specific frequency in order to reduce the level of the exhaust noise caused by this oscillation. A length $L_3$ of the resonance chamber 42 in the exhaust direction is set to a length obtained by subtracting the length $L_1$ of the expansion chamber 11 from an entire length $L_0$ of the muffler 2 in the exhaust direction. An open end portion 21 of the inlet pipe 3 on the muffler 2 side communicates with the expansion chamber 11 via the resonance chamber 42, and a plurality of punch holes 44 formed in the peripheral wall of the open end portion 21 face the resonance chamber 42, and thus communicate with the resonance chamber 42.

Exhaust gas from the internal combustion engine is introduced into the expansion chamber 11 and expands therein, whereupon the exhaust gas is discharged into the atmosphere from the outlet pipe 4. Hence in this embodiment also, by setting the relationship of $L_2$ being approximately $2nL$, similarly to the first embodiment, air column resonance of the $n^{th}$ harmonic generated inside the outlet pipe 4 can be favorably suppressed. Since the resonance chamber 42 is provided separately inside the muffler 2, exhaust noise of a predetermined frequency, such as high frequency sound waves, can also be reduced inside the muffler 2.

Third Embodiment

Figure 4:
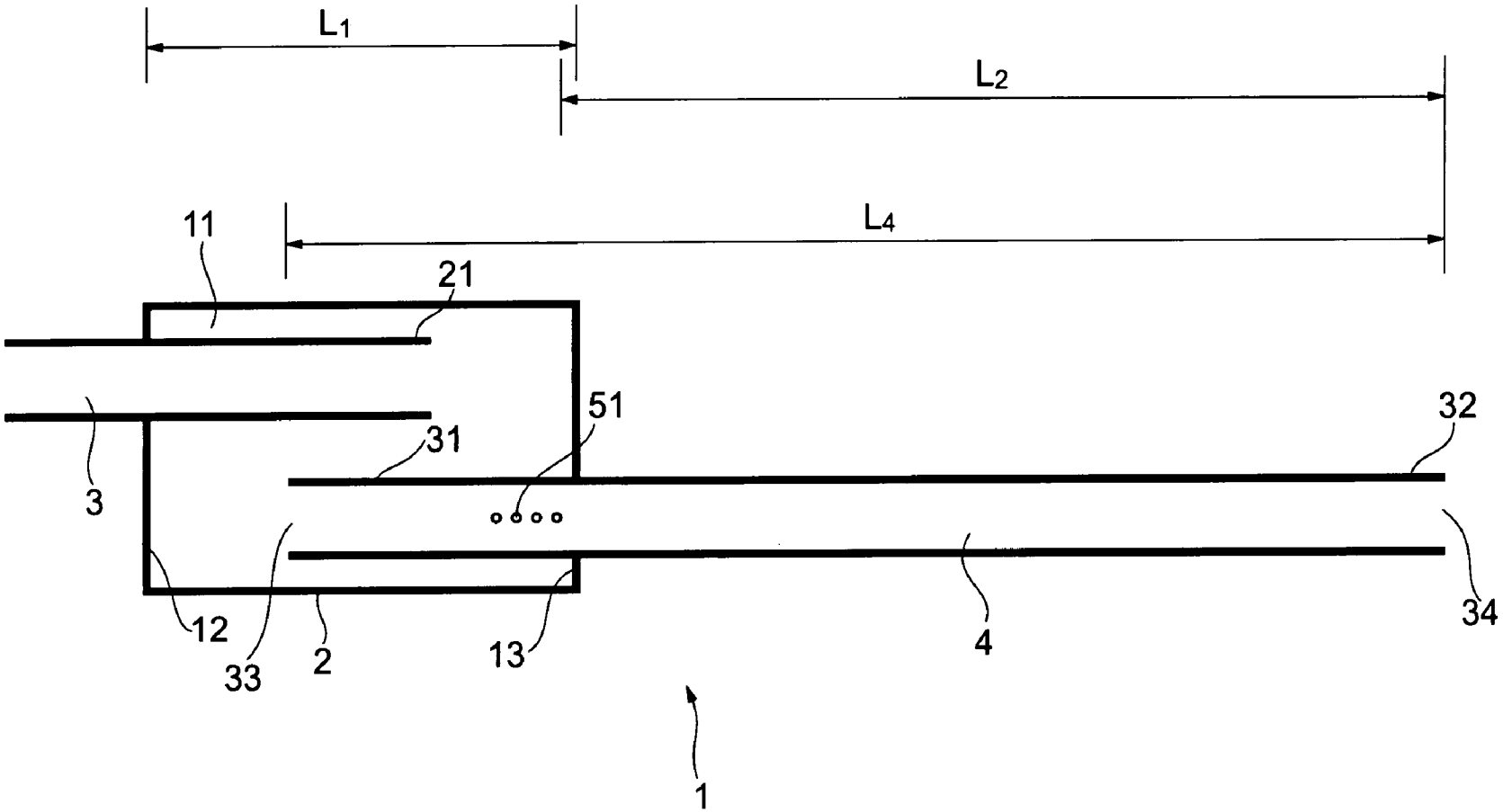
FIG. 4 is a schematic diagram showing an outline of an exhaust muffling device according to a third embodiment of the present invention.

As shown in FIG. 4, in the exhaust muffling device 1 according to a third embodiment, the inlet pipe 3 and outlet pipe 4 communicating with the expansion chamber 11 inside the muffler 2 are not disposed coaxially. Further, these pipes 3, 4 are inserted more deeply into the muffler 2 than in the first embodiment such that they overlap. An entire length of the outlet pipe 4 is set to $L_4$, and an open end portion 31 thereof near one open end face 33 communicates with the expansion chamber 11. The outlet pipe 4 comprises a plurality of bypass holes 51 (through holes) formed in a peripheral wall thereof in positions on the inner wall 13 side near the open end portion 31. The plurality of bypass holes 51 communicate with the expansion chamber 11.

In this embodiment, air column resonance is generated inside the outlet pipe 4 in accordance with a pipe length from an open end face 34 near the other open end portion 32 of the outlet pipe 4, which communicates with the outside, to the closest bypass hole 51 to the open end face 34, and hence this pipe length ("the substantial air column length") is set as $L_2$ (being approximately $2nL_1$) as described above. The exhaust gas which passes through the inlet pipe 3 and expands in the expansion chamber 11 flows into the outlet pipe 4 from the open end face 33 of the outlet pipe 4, whereupon a part of the exhaust gas flows into the outlet pipe 4 through the plurality of bypass holes 51. In other words, the exhaust gas flowing into the outlet pipe 4 converges at the positions of the bypass holes 51, and is then discharged into the atmosphere.

According to this embodiment, the substantial air column length of the outlet pipe 4 and the length of the expansion chamber 11 are set similarly to the first embodiment such that $L_2$ being approximately $2nL_1$, and hence air column resonance of the $n^{th}$ harmonic can be suppressed effectively by means of an interference effect inside the expansion chamber 11. Furthermore, by inserting the inlet pipe 3 and outlet pipe 4 into the expansion chamber 11 and employing the plurality of bypass holes 51 in the manner described above, exhaust noise can be muffled in a wider frequency range than that of the first embodiment.

Fourth Embodiment

Figure 5:
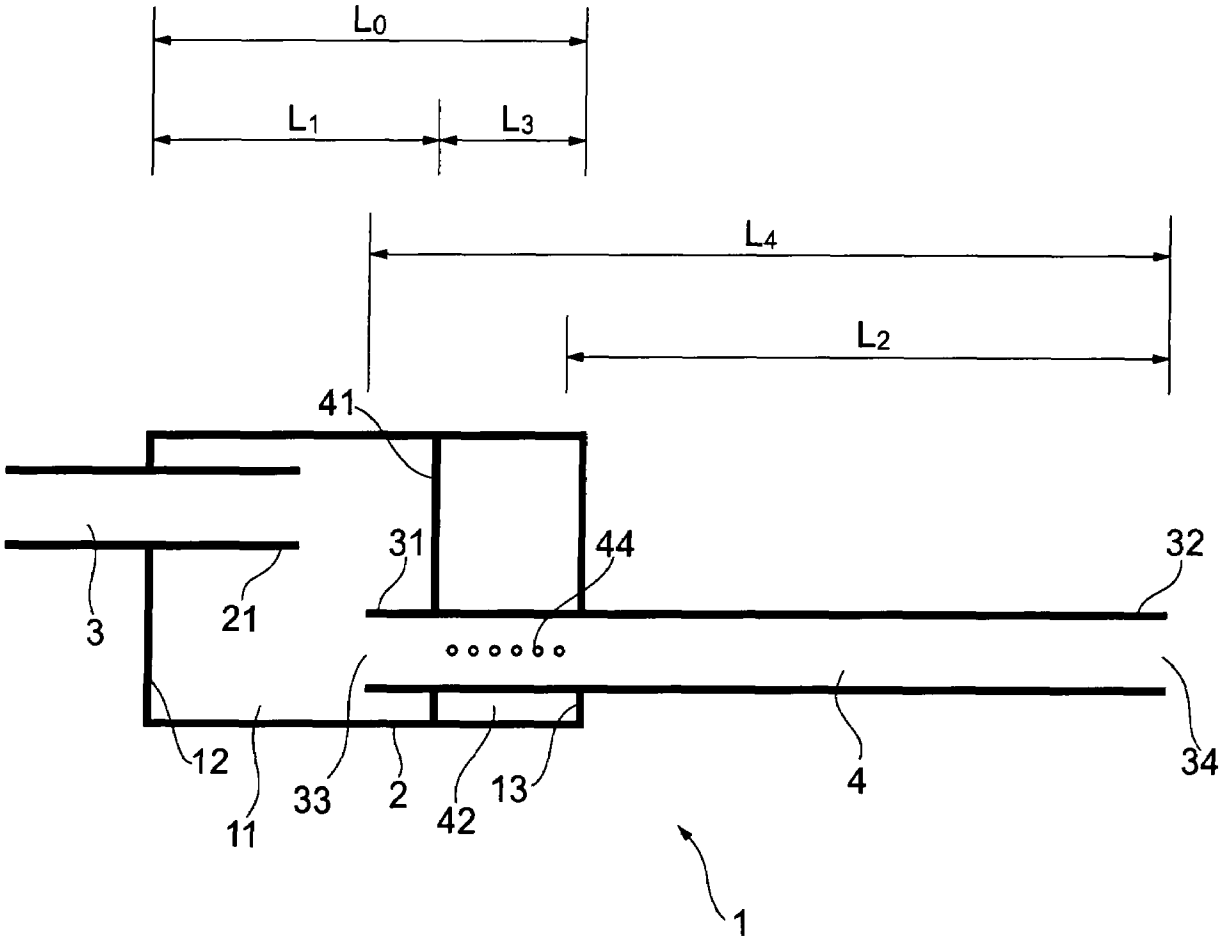
FIG. 5 is a schematic diagram showing an outline of an exhaust muffling device according to a fourth embodiment of the present invention.

As shown in FIG. 5, the interior of the muffler 2 in the exhaust muffling device 1 according to a fourth embodiment is separated into the expansion chamber 11, which is disposed on the inlet pipe 3 side, and a resonance chamber 42, which is disposed on the outlet pipe 4 side, using a separator 41. The length $L_1$ of the expansion chamber 11 in the exhaust direction corresponds to a distance from the inner wall 12 of the muffler 2 on the inlet pipe 3 side to the separator 41. The length $L_3$ of the resonance chamber 42 in the exhaust direction corresponds to a length obtained by subtracting the length $L_1$ of the expansion chamber 11 from the entire length $L_0$ of the muffler 2 in the exhaust direction.

The open end face 33 of the outlet pipe 4 near the muffler 2 communicates with the expansion chamber 11, and the plurality of punch holes 44 (through holes) formed in the peripheral wall of the open end portion 31 at the open end face 33 face the resonance chamber 42, and thus communicate with the resonance chamber 42. Similarly to the third embodiment, air column resonance is generated inside the outlet pipe 4 in accordance with a pipe length from the other open end face 34 of the outlet pipe 4, which communicates with the outside, to the closest punch hole 44 to the open end face 34, and hence this pipe length ("the substantial air column length") is set as $L_2$, which is approximately equal to $2nL_1$.

The exhaust gas which expands in the expansion chamber 11 flows into the outlet pipe 4 through the open end face 33, and is then discharged into the atmosphere. A part of the exhaust gas flowing into the outlet pipe 4 flows into the resonance chamber 42 through the punch holes 44, and it is here that the exhaust gas resonance effect occurs.

Accordingly in this embodiment, similarly to the third embodiment, the relationship of $L_2$ being approximately $2nL$, is established, and therefore air column resonance of the $n^{th}$ harmonic can be favorably suppressed. Furthermore, similarly to the second embodiment, the resonance chamber 42 is provided separately inside the muffler 2, enabling exhaust noise of a predetermined frequency, such as high frequency sound waves, to be reduced inside the muffler 2.

The entire disclosure of Japanese Patent Application No. 2003-415415 filed on Dec. 12, 2003 including specification, claims, drawings and summary are incorporated herein by reference in its entirety.

We claim:

1. An exhaust muffling device comprising:

a muffler having an expansion chamber whose length is L in an exhaust direction;

an inlet pipe having a first open end and a second open end, the first open end in direct communication with an outside of the muffler and the second open end in direct communication with the expansion chamber; and an outlet pipe having a first open end face, a second open end face and a through hole formed in a peripheral wall of the outlet pipe near the first open end face, the outlet pipe having no openings in the peripheral wall from the through hole to the second open end face, wherein the first open end face is in direct communication with the expansion chamber, the through hole is in communication with an inside of the muffler, an exhaust gas is exhausted from the outlet pipe into an atmosphere, and a length of the outlet pipe from the through hole to the second open end face is approximately 2nL and is based on the length L of the expansion chamber, a natural number n, and an open end correction of the outlet pipe so as to suppress air column resonance.

2. The exhaust muffling device according to claim 1, wherein the muffler further comprises a resonance chamber adjacent to the expansion chamber.

3. The exhaust muffling device according to claim 2, wherein the through hole communicates with the resonance chamber.

4. The exhaust muffling device according to claim 1, wherein the through hole communicates with the expansion chamber.

5. The exhaust muffling device according to claim 1, wherein the natural number n is 1.

6. The exhaust muffling device according to claim 1, wherein the natural number n is 2.

7. A method of suppressing air column resonance generated in an exhaust pipe, comprising:

directing exhaust through a muffler inlet pipe into a muffler expansion chamber whose length is L in an exhaust direction, the muffler inlet pipe having a first open end and a second open end, the first open end in direct communication with an outside of the muffler and the second open end in direct communication with the muffler expansion chamber; and directing exhaust through a muffler outlet pipe having a first open end face, a second open end face and a through hole formed in a peripheral wall of the outlet pipe near the first open end face, the outlet pipe having no openings in the peripheral wall from the through hole to the second open end face, wherein the exhaust enters the outlet pipe from the expansion chamber through the first open end face, enters the outlet pipe through the through hole from an inside of the muffler, and exits the outlet pipe through the second open end face to an atmosphere, the distance from the through hole to the second open end face being approximately 2nL so as to suppress air column resonance in which n is a natural number.

* * * * *